United States Patent [19]

Jacob

[11] Patent Number: 5,026,274

[45] Date of Patent: Jun. 25, 1991

[54] HOLDING DEVICE FOR A LIGHTER

[76] Inventor: Hannes Jacob, Köschenrütistrasse 77, CH-8052 Zürich, Switzerland

[21] Appl. No.: 393,991

[22] Filed: Aug. 15, 1989

[30] Foreign Application Priority Data

Aug. 31, 1988 [CH] Switzerland ..... 03253/88

[51] Int. Cl.[5] ..... F23Q 2/32

[52] U.S. Cl. ..... 431/253; 431/343; 224/162; 224/252; 24/3 J; 24/3 L

[58] Field of Search ..... 431/144, 146, 253, 343; 242/96, 107; 224/162, 252; 24/3 R, 3 L, 3 K, 3 J, 13

[56] References Cited

U.S. PATENT DOCUMENTS

| | | | |
|---|---|---|---|
| 282,476 | 7/1883 | Williams | 242/107 |
| 476,699 | 6/1892 | Terpening | 242/107 |
| 773,645 | 11/1904 | Joll | 242/107 |
| 4,082,496 | 4/1978 | Johnson | 431/253 X |
| 4,433,498 | 2/1984 | Bienz | 24/3 K X |
| 4,486,169 | 12/1984 | Lewis | 431/343 X |
| 4,538,751 | 9/1985 | Peterson | 224/252 |
| 4,898,532 | 2/1990 | Bercik | 431/253 |
| 4,927,354 | 5/1990 | Sanford | 431/253 |

FOREIGN PATENT DOCUMENTS

| | | | |
|---|---|---|---|
| 2399617 | 2/1979 | France . | |
| 59846 | 5/1958 | India | 24/3 K |

*Primary Examiner*—Carl D. Price

[57] ABSTRACT

The holding device consists of a housing having a means of attachment and suspension. The housing contains an extension device formed by a reel and return spring for a tension cord attached to the reel. The cord passes through an opening in the housing and is used for attaching the lighter. A catch shaft for the lighter surrounds the opening in the housing.

8 Claims, 2 Drawing Sheets

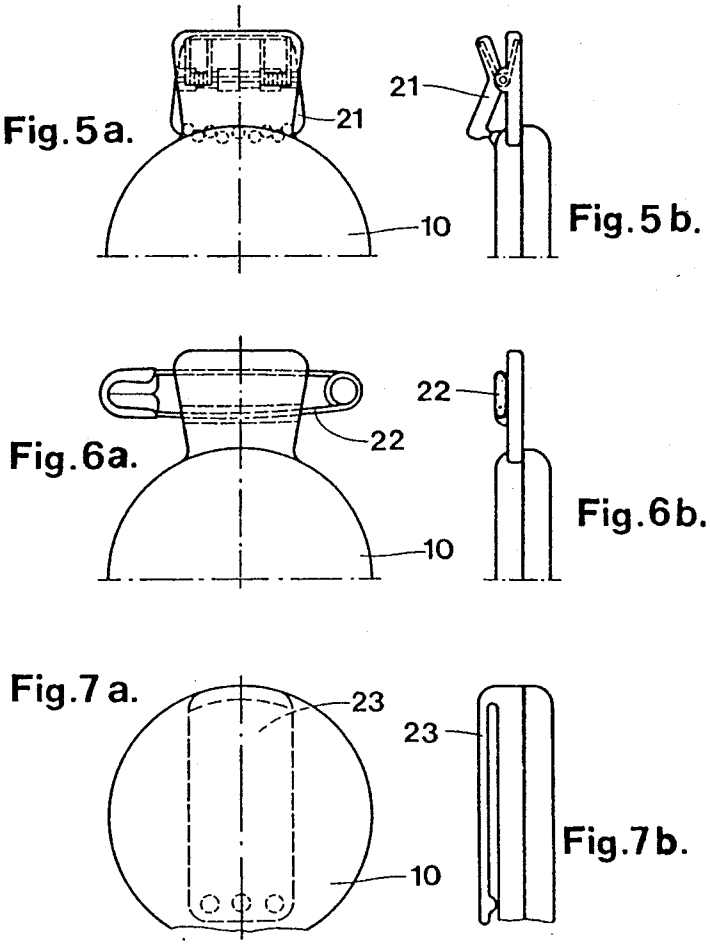
Fig.5a.
Fig.5b.
Fig.6a.
Fig.6b.
Fig.7a.
Fig.7b.
10
21
22
23
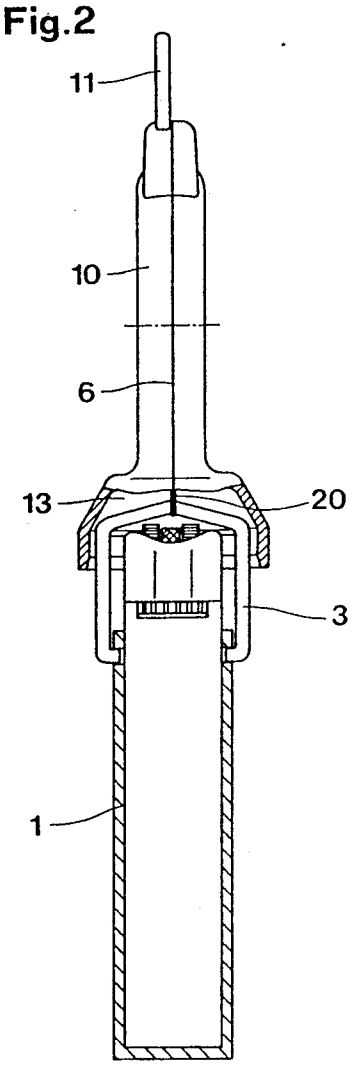
Fig.2
11
10
6
13
20
3
1
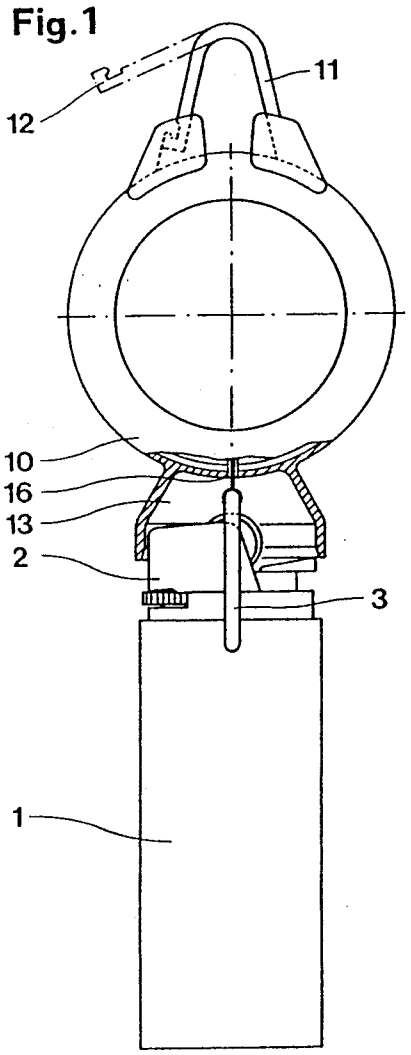
Fig.1
11
12
10
16
13
2
3
1

HOLDING DEVICE FOR A LIGHTER

BACKGROUND TO THE INVENTION

Lighters are indispensable utensils, especially for smokers. A lighter is a 'constant companion' for those who use them, but it can be easily misplaced, so that its owner has to search handbags, clothes and so forth to find it and/or awkwardly 'dig it out'. Moreover, lighters are easy to lose or leave behind due to forgetfulness.

The present invention relates to a holding device for a lighter. Purpose of the invention is to obviate the annoying everyday occurrences described above and to ensure that the lighter is always ready to hand.

SUMMARY OF THE INVENTION

The device to which this invention relates is characterized by a housing which has a means of attaching and suspending the holding device which contains an extension device formed by a reel and return spring for a tension cord attached to the reel, the cord passing through an opening in the housing and used for attaching the lighter, the opening in the housing being surrounded by a receiving well for the lighter.

The device together with the lighter is attached, for example to a handbag, a belt loop, a buttonhole etc, by a means of attachment and suspension, or may be worn at the wrist or round the neck, thus obviating the need for searching and awkwardly 'digging it out'. The device accommodates the top of the lighter in a receiving well which protects it from humidity and thus substantially increases the lighter's functional reliability; this receiving well also prevents pockets, handbags, clothes etc being soiled by soot, ash, and other residue from the lighter's flame, wick, fuel, flint, and/or sparking mechanism. The holding device is also suitable for use as a publicity gift, its housing serving as advertising medium. Preferred and suitable embodiments of the object of the device defined in claim 1 of the present disclosure are given in claims 2 to 8.

Various embodiments of the holding device in accordance with the present invention are explained more specifically below in conjunction with the drawings.

BRIEF DESCRIPTION OF THE DRAWINGS

FIG. 1 shows the front view, partly in section, of the first embodiment of the holding device in accordance with the present disclosure;

FIG. 2 shows the side view, partly in section, of the first embodiment of the holding device in accordance with the present disclosure;

FIGS. 5 to 7 show the front (a) and side (b) views of various alternative means of attachment and suspension of the device in accordance with the present disclosure.

DESCRIPTION OF THE PREFERRED EMBODIMENTS

Figure 4:
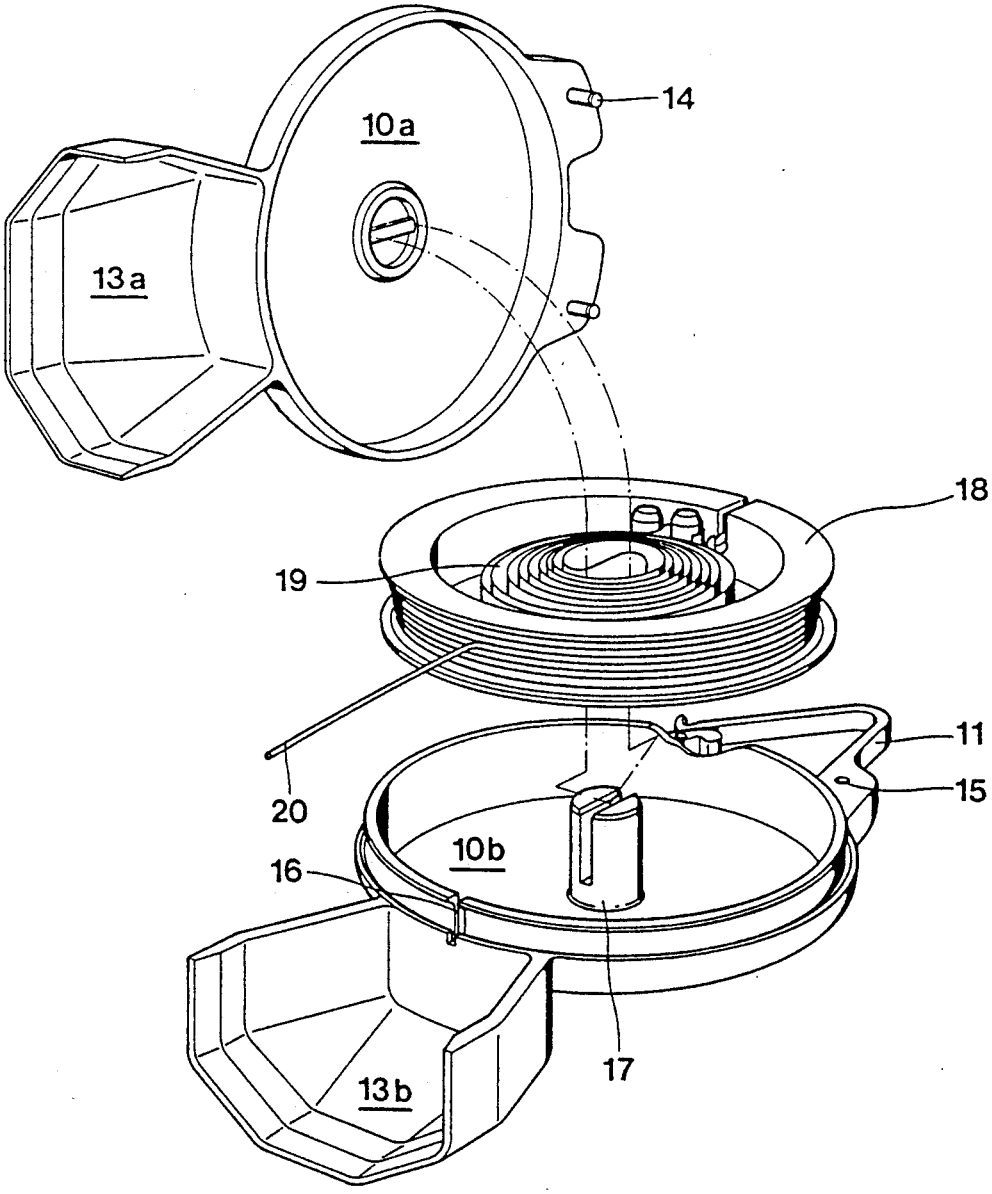
FIG. 4 is an exploded perspective view of the device in accordance with FIGS. 1 and 2.

The holding device for the lighter 1 shown in FIGS. 1, 2, and 4 has a box-shaped housing 10 to whose rim is attached a means of attachment and suspension 11. In this case the means of attachment and suspension 11 consists of a U-shaped or V-shaped loop, one of whose legs is firmly secured to the housing 10 and whose other leg has a barb 12 which can be firmly anchored in a catch hook on the housing; a dash-dotted line indicates the open position of the loop. On the housing lo or on its rim, opposite the means of attachment and suspension 11, a receiving well 13 is formed which accommodates the lighter's top 2 including the sparking mechanism and the flame source, such as a gas jet with the lower body portion of the lighter suspended below. As shown on FIG. 4, housing 10 and receiving well 13 are split along a separation plane 6 (FIG. 2) into two halves 10*a*, 13*a*, or 10*b*, 13*b*. To prevent the two half shells rotating relative to each other, pins 14 may be used, for example, to engage in holes 15. In assembly, the two half shells of the housing may be bonded to each other or be connected, for example by snap-fit locking of the rims of the two half shells on each other. Inside the housing 10 there is an extension device for a tension cord 20 which passes through an opening 16 in the housing. The receiving well 13 surrounds this opening 16. FIG. 4 indicates the manner in which the extension device is built up, as follows: The device consists of a reel 18 and a spiral return spring 19. The inner end of the spring 19 engages in a slot of a central peg 17 on the housing, its outer end is connected to the reel 18. The end of the tension cord 20 is attached to the reel 18. The cord remains wound on the reel as long as the lighter 1 is not in use and its top 2 remains in the catch shaft 13. The lighter 1 is attached to the other end of the tension cord 20 outside the housing 10, preferably by means of a loop 3 bent to grip the housing of the lighter in such a way that it can be hinged over the top 2 of the lighter or to its side.

Figure 3:
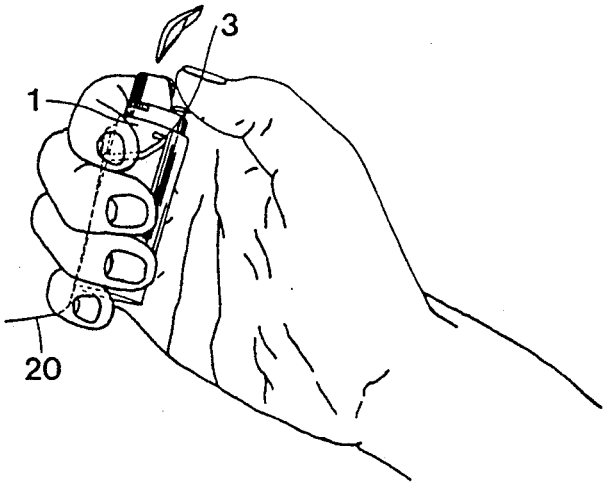
FIG. 3 shows the use of a lighter attached to the tension cord.

For use, the hand holds the lighter 1 and pulls it out of the device which is attached, for example, to clothing, a handbag handle, etc. The tension cord 20 passes out through the opening 16 in the housing, unwinds from the reel 18, and tensions the spiral spring 19. If the lighter is held normally as shown in FIG. 3, the tension cord 20 pulls the hinged loop 3 aside and the lighter can be used in the usual way. When the lighter is released after use, the tension cord 20 is immediately rewound on the reel 18 by the tensioned return spring 19. As the cord is rewound, the top of the lighter 2 automatically returns into the receiving well 13. In this position of rest, the return spring must be pretensioned sufficiently to overcome the weight of the lighter 1 and hold the lighter firmly against the housing 10.

The shape of the receiving well 13 can be made to fit the shape of any lighter, as necessary; the shaft can also be made deeper, in order to accommodate a greater part of the length of the lighter. The tension cord may be attached directly to the lighter instead of by a hinged loop 3.

The means 11 for attaching and suspending the housing 10 may be made differently from the form shown in FIGS. 1, 2, and 4. FIG. 5, for example, shows a clothespeg type of spring clip 21 attached to the housing 10; FIG. 6 shows a safety pin 22 secured to the housing; and FIG. 7 shows a spring clip 23 formed integrally with or attached to the housing.

I claim:

1. A lighter in combination with a holding device therefor comprising: a lighter having a top, including a sparking mechanism and flame source, and a lower body portion; a housing with means for attachment and suspension of the housing, an extension device contained in the housing and formed by a return spring and reel with an attached tension cord having one end which passes through an opening in the housing and is attached to the top of the lighter, the opening of the housing being surrounded by a receiving well for the lighter.

2. A lighter in combination with a holding device in accordance with claim 1, wherein the tension cord is attached to the lighter by a loop which pivotally connects to the top of the lighter.

3. A lighter in combination with a holding device in accordance with claim 1 wherein the receiving well is integrally formed on the housing.

4. A lighter in combination with a holding device in accordance with claim 1 wherein the housing is a box-shaped housing, and the receiving well and the means for attachment and suspension are located opposite each other on the rim of the housing.

5. A lighter in combination with a holding device in accordance with the above claim 3 wherein the housing and integral receiving well are split into two halves along a separation plane.

6. A lighter in combination with a holding device in accordance with claim 1 wherein the means for attachment and suspension are formed by a U-shaped or V-shaped loop, having one leg firmly secured to the housing and another leg with a barb which can be firmly anchored in a catch hook on the housing.

7. A lighter in combination with a holding device in accordance with claim 1 wherein the means for attachment and suspension is formed by a safety pin attached to the housing.

8. A lighter in combination with a holding device in accordance with claim 1 wherein the means for attachment and suspension is formed by a spring clip attached to or formed as part of the housing.

* * * * *